United States Patent [19]

Anderson

[11] Patent Number: 4,570,290

[45] **Date of Patent: * Feb. 18, 1986**

[54] HINGE HAVING A LATERALLY OUTWARDLY EXTENDING FLAT SPRING

[75] Inventor: John P. Anderson, Ontario, Calif.

[73] Assignee: Hartwell Corporation, Placentia, Calif.

[ * ] Notice: The portion of the term of this patent subsequent to Jun. 26, 2001 has been disclaimed.

[21] Appl. No.: 682,565

[22] Filed: Dec. 14, 1984

Related U.S. Application Data

[63] Continuation of Ser. No. 415,336, Sep. 7, 1982, abandoned, which is a continuation-in-part of Ser. No. 284,922, Jul. 20, 1981, Pat. No. 4,455,711.

[51] Int. Cl.[4] ..... E05D 7/10

[52] U.S. Cl. ..... 16/229; 16/258; 16/262; 16/380; 16/386

[58] Field of Search ..... 16/225, 229, 257, 258, 16/259, 262, 263, 265, 266, 270, 380, 381, 386, 374, 375, 377, DIG. 36

[56] References Cited

U.S. PATENT DOCUMENTS

| | | | |
|---|---|---|---|
| 2,186,789 | 1/1940 | Rosenberg | 16/229 |
| 3,284,842 | 11/1966 | Jennings | 16/386 |
| 3,908,227 | 9/1975 | Cain | 16/229 |
| 3,924,293 | 12/1975 | Cain | 16/380 |
| 4,178,657 | 12/1979 | Way, Jr. | 16/229 |
| 4,455,711 | 6/1984 | Anderson | 16/229 |

FOREIGN PATENT DOCUMENTS

| | | | |
|---|---|---|---|
| 1338240 | 8/1963 | France | 16/386 |

OTHER PUBLICATIONS

"Kwik Release Hinge Assemblies", Burklyn Hinge, Division of The Hartwell Corp., numbered here as pp. 1–4, published prior to Jul. 20, 1980.

Drawings of various hinges manufactured and sold by The Hartwell Corp., numbered here as pp. 5–11, sold prior to 7/20/81.

*Primary Examiner*—Fred Silverberg

*Attorney, Agent, or Firm*—Lyon & Lyon

[57] ABSTRACT

A quick release hinge/latch for removably attaching two surfaces including a keeper adapted to attach to a surface and having an edge portion in the form of a hollow keeper tube, a housing adapted to attach to another adjacent surface and also having an edge portion in the form of a hollow housing tube such that the keeper tube and housing tube fit together to form an extended tube, a pin which slides within the extended tube to detachably connect the keeper and housing and a flat spring/actuator which attaches to the pin through an opening in the housing tube. The spring/actuator when in a first position holds the pin partially extended into the keeper tube. When the leg portions of the spring/actuator are pinched together and into a second position the pin is withdrawn from the keeper tube. The pinched spring/actuator can then be rotated about the housing tube axis into a third position where the spring-/actuator locks into a radial opening in the housing tube to thereby lock the pin entirely within the housing tube allowing easy detachment of the housing from the keeper.

10 Claims, 23 Drawing Figures

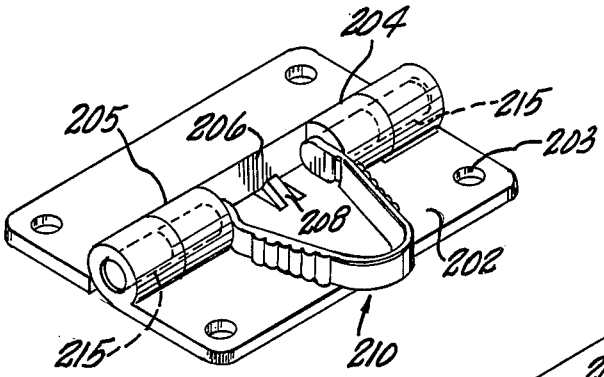
FIG. 18.
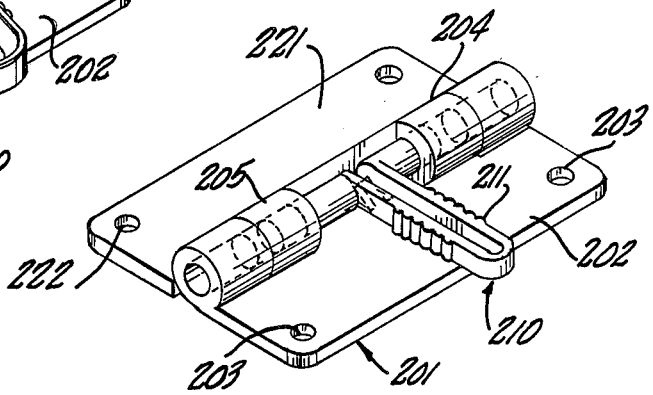
FIG. 19.
FIG. 20.
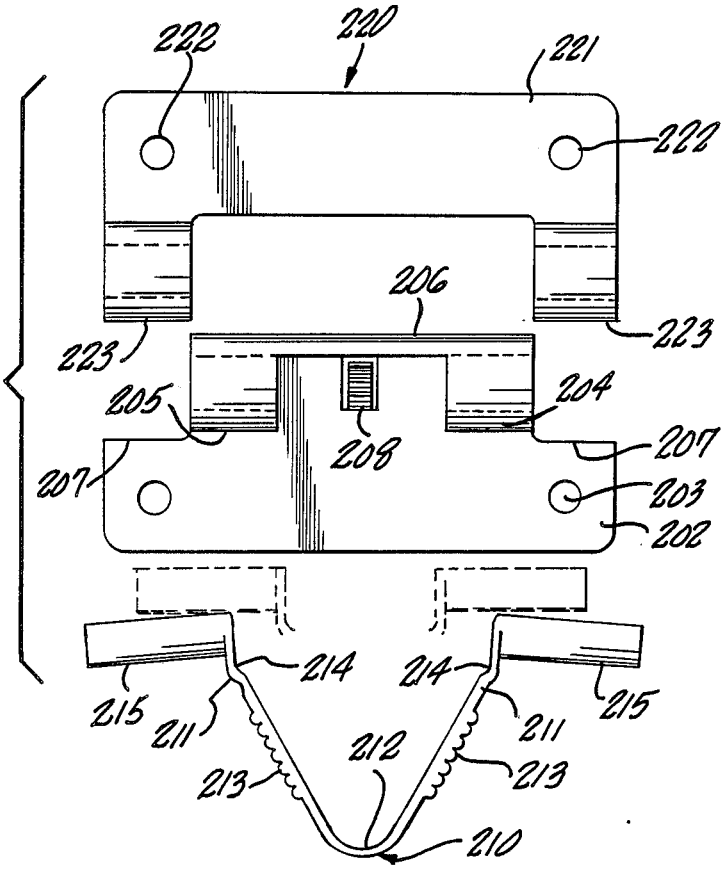

HINGE HAVING A LATERALLY OUTWARDLY EXTENDING FLAT SPRING

CROSS-REFERENCE TO RELATED APPLICATION

This application is a continuation, of application Ser. No. 415,336, filed 9-7-82 now abandoned, which is a continuation-in-part of an application of JOHN P. ANDERSON entitled QUICK RELEASE HINGE/-LATCH, filed July 20, 1981, Ser. No. 284,922, which application later issued as U.S. Pat. No. 4,455,711 on June 26, 1983.

BACKGROUND OF THE INVENTION

A large market exists for hinges and latches. Such a market includes a demand for hinges and latches that will attach to doors or panels and which will allow rapid detachment or replacement of doors, panels, modules and printed circuit boards as well as quick access to closed-off areas.

Many of the existing hinges and latches are not capable of being made entirely from non-metallic materials. Thus, they may have conductive metal parts which risk contacting electrical wiring or which corrode or which weigh too much for some applications. Many existing hinges and latches also require an awkward number of assembly steps. Further, the relatively large number of components of some hinges and latches create problems of reliability, inventory records, and storage space.

SUMMARY OF THE INVENTION

By this invention a hinge/latch is provided which will allow for rapid attaching and detaching of two adjacent surfaces.

A further object of this invention is to provide a quick release hinge/latch device which is capable of being made entirely from non-metallic materials to thereby reduce electrical, corrosion and weight problems.

A still further object of this invention is to provide a quick release hinge/latch device which can be assembled in a relatively small number of steps.

A still further object of this invention is to provide a quick release hinge/latch device which has a relatively small number of components to thereby minimize reliability and storage problems.

A still further object of this invention is to provide a quick release hinge/latch device comprising a housing adapted to attach to a first surface and having an edge portion in the form of a hollow tube or tubes said tube(s) having an axial opening with a radial portion or portions, a pin or pins for sliding within and partially beyond said tube or tubes, a flat spring with two leg portions which is partially outside said tube or tubes and which attaches to one end of each pin communicating thereto through the axial opening. When the flat spring is at rest in a first position it holds the pin or pins in extension partially beyond the housing tube(s) such that said pin(s) removably connect to a second surface either directly or by means of a keeper attached to the second surface said keeper having a tube portion adapted to receive said pin(s). When the spring leg portions are pressed toward each other to a second position the pin(s) are thereby pulled entirely into the housing tube(s) to detach the housing from said second surface. The spring can also be rotated about the housing tube axis to a third position with the spring leg portions communicating with the pin or pins through the radial portion(s) of the axial opening to thereby hold the pin(s) retracted entirely within the housing tube(s).

A still further object of this invention is to provide serrated edges on the surface of the leg portions of the spring to aid in moving said spring into various positions.

A still further object of this invention is to provide a quick release hinge/latch device comprising a serrated spring/actuator having a pin integral therewith wherein the spring/actuator is integral with a housing adapted to attach to a first surface. In the operative position, the pin means is disposed in a housing tube and a keeper tube means to facilitate attachment of two surfaces. In the inoperative state the pin means is retracted from the keeper tube but is retained in the housing tube means by a stop.

A still further object of the present invention is to provide a C-shaped spring/actuator having two pins which are adapted to selectively slide into opposing keeper hollow tube means to permit hinged attachment of two surfaces. In the inoperative position, the opposing pin means are retracted from the keeper hollow tube means but retained in housing tube means by a stop.

IN THE DRAWINGS

FIGS. 1A, 1B, and 1C are side elevational views of an exemplary version of the invention.

FIG. 18 is an elevational view of the exemplary version of the fifth embodiment of the invention.

FIG. 19 is an elevational view of the exemplary version of the fifth embodiment of the invention in the second position.

FIG. 20 is an exploded view of the components of the exemplary version of the fifth embodiment of the invention.

DETAILED DESCRIPTION

Figure 1A:
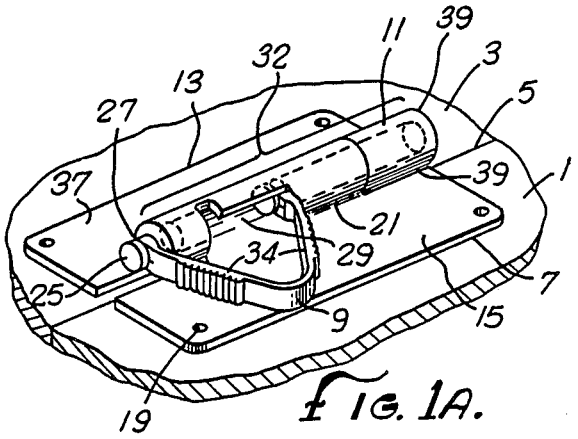

Referring now to FIGS. 1–4, a first preferred embodiment of the quick release hinge/latch is shown. The invention in environment is shown in FIG. 1A, the environment consisting of a first surface 1 adjacent to a second surface 3 thereby forming a surface edge 5.

The invention as shown in FIGS. 1–4 includes a housing 7, a spring/actuator 9, a pin 11 and a keeper 13. These pieces may be made from plastic.

The housing 1 as shown in FIGS. 1–4 consists of a substantially flat rectangular base portion 15 which rests on the first surface 1 and attaches to said surface by, for example, screws through holes 19 in said rectangular base portion 15, and an edge portion in the form of a hollow housing tube 21. Said housing tube 21 is located near and parallel to the surface edge 5 when the housing 7 is attached to said first surface 1. The hollow housing tube 21 has one open end 23 and one end 25 with a radial groove 27 in its exterior surface. The housing tube 21 further has an external lateral opening with an axial portion 29 and a radial portion 31.

The pin 11 slides within the hollow housing tube 21. One end, the housing end 30, of the pin 11 has a radial groove 33 in its exterior surface.

The spring/actuator 9 is a C-shaped flat spring with two leg portions 34 each with a foot in the form of clipping jaws 35. The outer surface of the spring/actuator 9 is serrated to allow for easy gripping of the spring-/actuator.

The keeper 13 comprises a flat rectangular base portion 37 and a keeper hollow tube 39 on an end of an edge portion of the keeper 13. The keeper hollow tube 39 fits next to the end 23 of the housing tube 21 and in alignment with a housing tube axis to thereby form an extended hollow tube 32 when the keeper 13 is attached to a second surface 3 said keeper 13 being attached such that it is parallel to the housing 7 and adjacent to said housing 7 across the surface edge 5.

To easily and quickly assemble the invention one slides the pin 11, the housing end 30 with the radial groove 33 being slid in first, into the hollow housing tube 21 via the open tube end 23. One jaw 35 of the spring/actuator is removably snapped onto the radial groove 33 of the pin 11, a portion of the spring/actuator passing through the opening 29 in said tube 21. The other jaw 35 of the spring/actuator is removably snapped onto the radial groove 27 on the end 25 of the housing tube 21. The invention at such a point in time will consist of an assembly as in FIG. 3 having the housing 7 and the pin 11 connected by the spring/actuator 9 and a separate keeper piece 13 shown in FIG. 2. The pin 11 is held in partial extension beyond the end 23 of the housing tube 21 by the spring/actuator 9. The extended end of the pin 11 can be slid into the hollow keeper tube 39 as in FIG. 4 and the housing base portion 15 attached to a first surface and the keeper base portion 37 attached to a second surface.

The assembly steps can, of course, be varied and the invention can also be disassembled by reversing assembly steps. Either the keeper or housing, or both, can be an integral portion of said first or second surfaces without changing the nature of this invention, in this or any other embodiment of the invention.

Figure 1B:
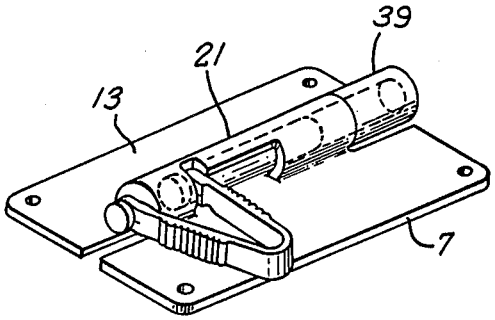
Figure 1C:
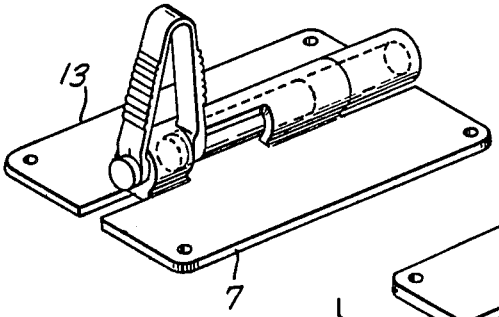
Figure 2:
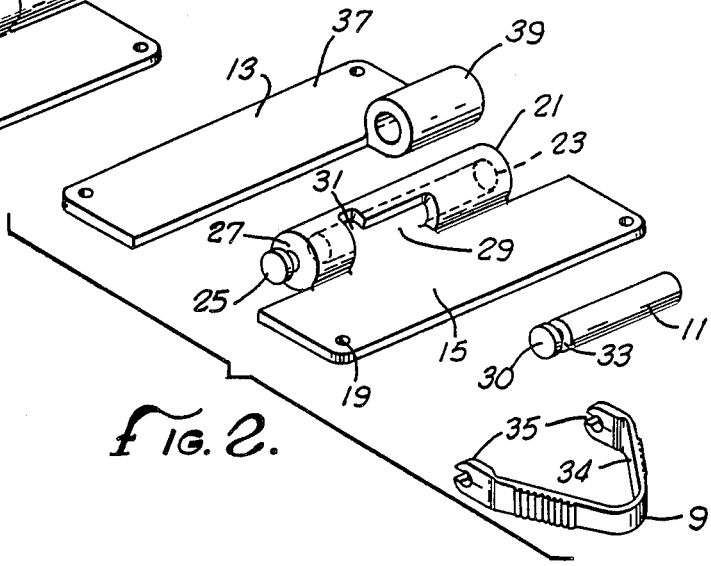
FIG. 2 is an exploded view of the components of the same exemplary version of the invention.
Figure 3:
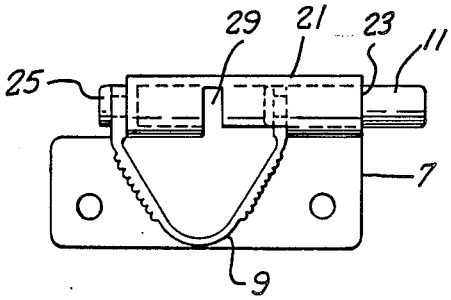
FIG. 3 is an elevational view of the same exemplary version of the invention.
Figure 4:
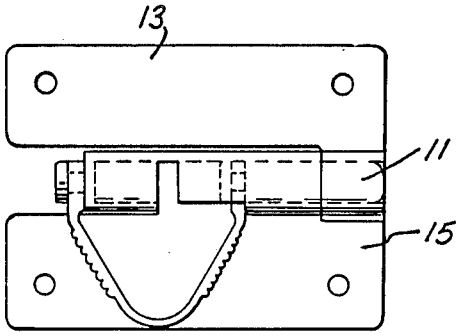
FIG. 4 is an elevational view of the same exemplary version of the invention further including a keeper.
Figure 5:
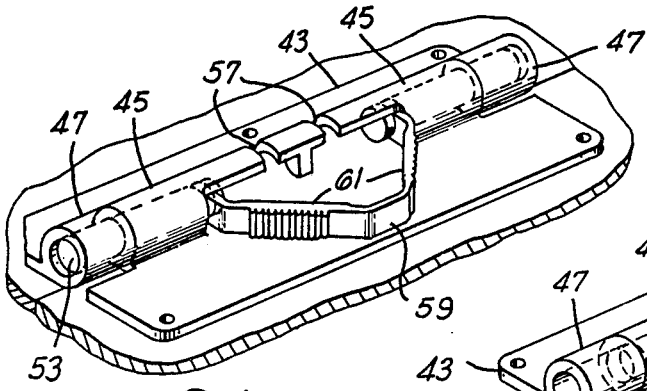
FIGS. 5, 5B and 6 are side elevational views of a second exemplary version of the invention.

Use of the invention is illustrated by FIGS. 1A, 1B and 1C. The spring/actuator 9 in FIG. 1A is in a first position resting substantially on the housing base portion 15. The spring/actuator 9 is in compression with one foot 35 detachably snapped over the radial groove 27 and thereby anchored to the end 25 of the housing tube and with the other foot 35 end detachably snapped over the radial groove 33 on the housing end of the pin 11. The expansion force of the spring/actuator 9 pushes the pin 11 partially out of the housing tube 21 and partially into the keeper tube 39 thereby attaching the first and second surfaces. In this first position a portion of a leg portion of the spring/actuator 9 rests in the axial portion 29 of the lateral housing opening at an extreme end of said axial portion.

The first position is a stable configuration as the spring/actuator is prevented from rotating about the housing tube axis because it comes into contact against either an edge of the housing tube above the axial opening 29 or against the housing base portion 15. The spring/actuator does not move along the housing tube axis because the portion of the leg portion pushes against and rests against an edge of the housing tube at the extreme end of the axial opening 29. The pin 11 attached to the spring/actuator 9 is also held in stable extended position thereby latching the first and second surfaces together. The pin 11, being cylindrical can also serve as a pivot pin. The keeper tube 39 which fits around the end of the pin 11 can rotate about an axis through the center of the pin, thereby making the invention serve as a hinge.

To detach the first and second surfaces 1 and 3 one grasps the spring/actuator 9 between one's thumb and forefinger and then one pinches the leg portions 34 of the spring/actuator together. This pulls the pin 11 entirely back into the housing tube 21 thereby disconnecting the end of the pin 11 from the keeper tube 39. When the spring/actuator 9 is in this pinched second position as shown in FIG. 1B the keeper 13 and housing 7 are entirely disconnected.

To maintain the keeper and housing detached the pinched spring/actuator 9 is rotated roughly 90° into a third position as shown in FIG. 1C. The portion of the leg portion 34 of the spring/actuator 9 that rested in the axial portion 29 of the lateral opening now rests within the radial portion 31 of said opening. The radial portion 31 has relatively narrow dimension along the housing tube axis compared to such dimension of the axial portion. Thus, when one releases the spring/actuator 9 said portion of the leg portion quickly abuts against an edge of the housing tube 21 thereby keeping the pin 11 locked entirely within the housing tube 21. The keeper 13 and housing 7 can now be easily separated as can the first and second surface 1 and 3 to which they are attached.

A second preferred embodiment of the invention is shown in FIGS. 5–10. This embodiment is very similar to the first such embodiment in structure and operation.

As shown in FIGS. 5 through 8 a housing 41 attaches to a first surface and a keeper 43 attaches to a second surface. The housing 41 has an edge portion in the form of a hollow housing tube 45. The keeper 43 has two edge end portions in the form of hollow keeper tubes 47. The keeper tubes 47 fit against each end of the housing tube 45 to form one extended hollow tube 48. A pin 49 slides within each half-end of this hollow tube. These pins 49 are of such length that each may fit entirely within one-half of the housing tube 45. Each pin 49 has two ends, a spring/actuator end 51 and a keeper end 53. The spring/actuator end 51 has a radial groove 52 in its exterior surface.

The housing tube 45 further has a lateral opening with an axial portion 55 and two radial portions 57.

Figure 7:
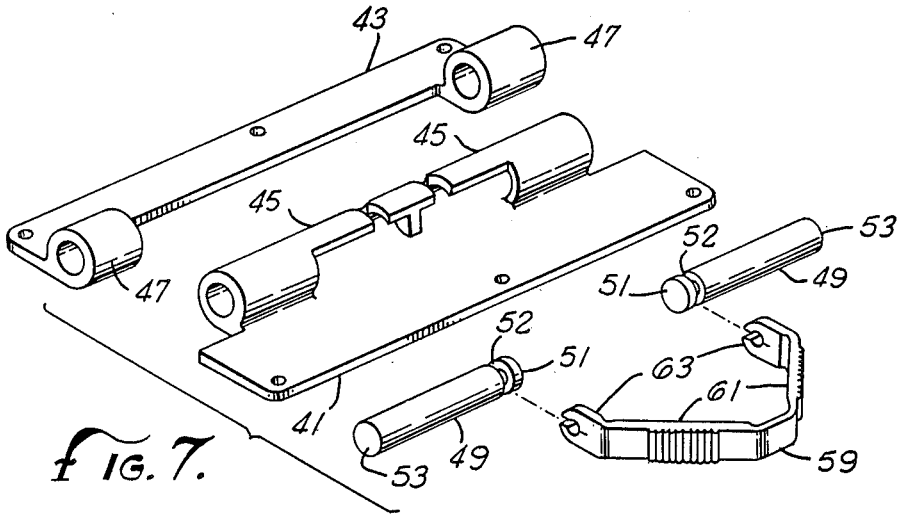
FIG. 7 is an exploded view of this second exemplary version.
Figure 14:
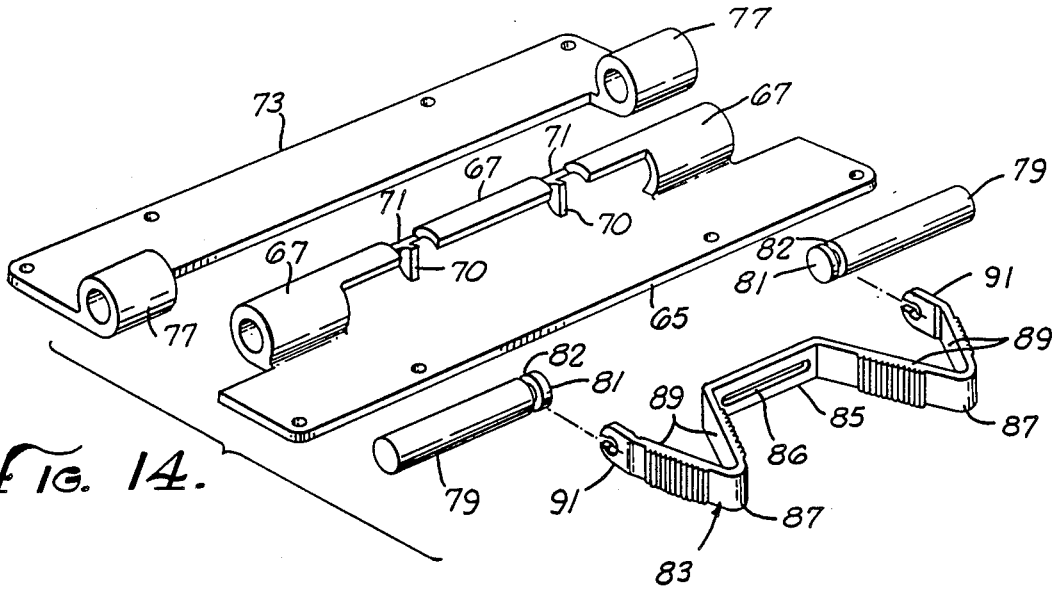
FIG. 14 is an exploded view of this third exemplary version.

This second preferred embodiment of the invention further has a spring/actuator 59 of the same structure as in the first embodiment. The spring/actuator as shown in FIG. 7 is C-shaped with two leg portions 61 which end in feet in the form of clipping jaws 63. The outside surface of the spring/actuator is serrated for better gripping.

Figure 8:
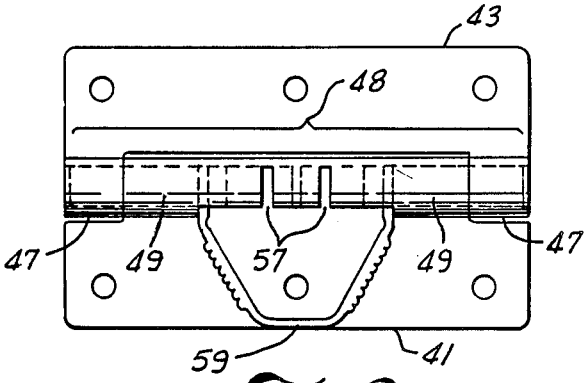
FIG. 8 is an elevational view of this second exemplary version.
Figure 10:
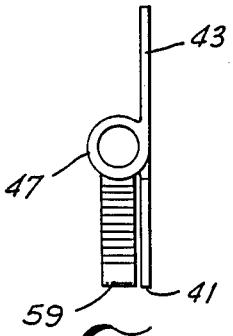
FIG. 10 is an end view of this second exemplary version.
Figure 9:
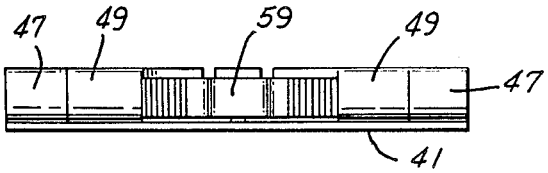
FIG. 9 is a side view of this second exemplary version.

To assemble this preferred embodiment, the spring-/actuator end 51 of each pin 49 is slid into each end of the housing tube 45. The feet 63 of the spring/actuator are pushed through the lateral opening in the housing tube 45 and are clipped onto the grooves 52 on the spring/actuator ends 51 of the pins 49 as in FIG. 5. The spring/actuator leg portions 61 are pinched toward each other pulling the pins 53 entirely into the housing tube 45. The keeper 43 is fitted together with the housing 47 such that the keeper tubes 47 fit against the ends of the housing tube 45 to form one extended tube 48. The spring/actuator 59 is released. It spreads apart sliding the pins 53 partially into each keeper tube 47 as shown in FIG. 8.

This second preferred embodiment operates quite similarly to the first preferred embodiment except that there are two pins. When the spring/actuator is in a first position as in FIGS. 5 or 8 the leg portions of the spring-/actuator 59 are spread by the spring expansion force of the spring/actuator 59 until a portion of each leg portion 61 abuts against an edge of the housing tube 45 at each end of the axial portion 55 of the lateral opening of the housing tube. The attached pins 49 are thereby extended partially beyond each end of the housing tube 45 and partially into respective keeper tubes 47.

The keeper 43 and housing 41 are thus latched together and through them any surfaces to which they are attached. The axial portion 55 of the lateral housing tube is narrow thus preventing the spring/actuator 59 from rotating about an axis through the housing tubes. The pins 49 are thus held in a stable position. The keeper tubes 47 which fit around the keeper ends 53 of the pins 49 can rotate about an axis through said pins allowing the invention to serve as a hinge.

Figure 5B:
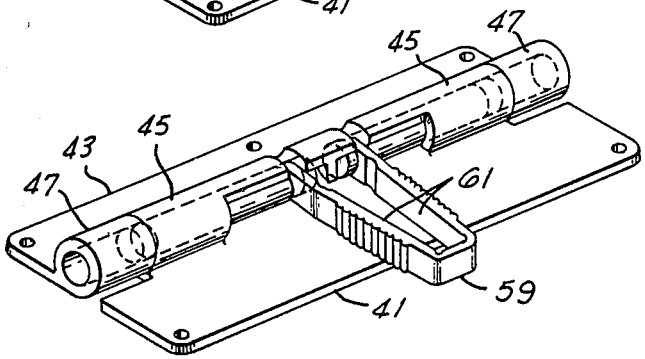

By pinching the leg portions 61 of spring/actuator 59 together into a second position (as in FIG. 5B) the pins are pulled back entirely into the housing tube. This detaches the keeper tubes 47 from the housing tube 49 thereby allowing the surfaces to which the keeper 43 and housing 41 are attached to separate.

Figure 6:
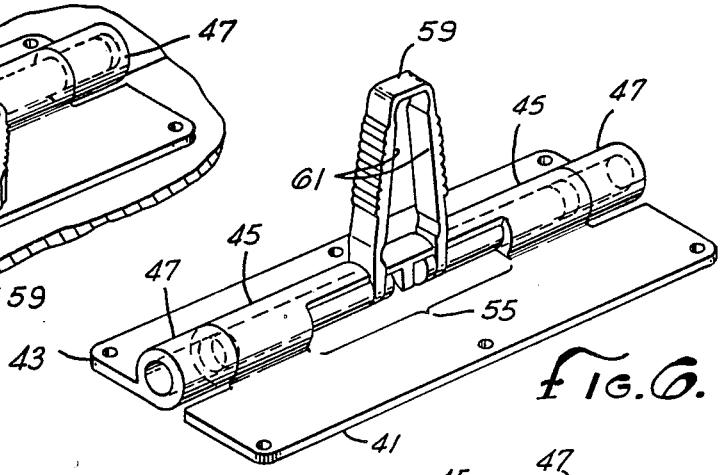

The pinched leg portions 61 of the spring/actuator can then be rotated roughly 90° about an axis through the center of the housing tube 49 as shown in FIG. 6. A portion of each leg portion 61 of the spring actuator 59 is now in each of the radial portions 57 of the lateral housing tube opening. When the pinched leg portions 61 are released, a portion of each of said leg portions quickly abuts against an edge of the housing tube 45 at the outer end of each radial portion 57. The spring/actuator is held in such a position as shown in FIG. 6 by its expansion spring force pushing the leg portions 61 against the housing tube edges. By such easy operations one may quickly release or attach two adjacent panels.

A third preferred embodiment of the invention is shown in FIGS. 11–14. This embodiment is similar in structure and ture and operation to the second preferred emboidiment. As in the second preferred embodiment there is a housing 65 with an edge portion in the form of a hollow housing tube 67. The housing tube 67 has a lateral opening with an axial portion 68 and two radial portions 71. A thin wall 70 divides the housing tube 67 across the housing tube axis and below each radial portion 71. A keeper 73 has edge end portions in the form of hollow keeper tubes 77 which fit against each end of the housing tube 67 and align axially therewith to form an extended hollow tube. A pin 79 slides within each half end of this extended tube. Each pin has a spring/actuator end 81 with a radial groove 82 in its exterior surface.

The spring/actuator 83 of this third preferred embodiment differs from the spring/actuator previously discussed in that it is roughly W-shaped, with an extension piece 85 between the inner top of each V-shaped portion 87 of the W-shaped spring/actuator 83. This extension piece 85 allows this embodiment to be relatively longer than the other embodiments. The extension piece 85 has a protruding portion 86 which protrudes from the center of said extension piece along its length. Each V-shaped portion 87 has two leg portions 89, the outer leg portion ending in a foot in the form of clipping jaws 91.

This preferred embodiment operates similarly to the other embodiments discussed. A pin 79 is slid, spring-/actuator end 81 first, into each end of the housing tube 67. The spring/actuator extension piece 85 fits into the center portion of the hollow housing tube 67 between each thin wall 70. These walls 70 prevent the spring from sliding in the housing tube 67. A foot 91 of the spring/actuator 83 clips onto the spring/actuator end 81 of each pin 79 and around the radial groove 82 on said ends. The outer legs of the spring/actuator are pinched toward each other thereby pulling the pins 79 entirely into the housing tube 67. The keeper 73 is fitted next to the housing 65 with the keeper tubes 77 fitting against the ends of the housing tube 67 to thereby form an extended hollow tube. The keeper 73 and housing 65 are attached to respective adjacent surfaces. When the pinched leg portions of the spring/actuator are released the expansion spring force of the spring/actuator 83 pushes each pin partially beyond each end of the housing tube and partially into a respective keeper tube 77. Thus, the pins attach the keeper 73 and housing 65 and latch together any surfaces to which said keeper 73 and housing 65 are attached. The invention also serves as a hinge as previously discussed re the second preferred embodiment.

Figure 11:
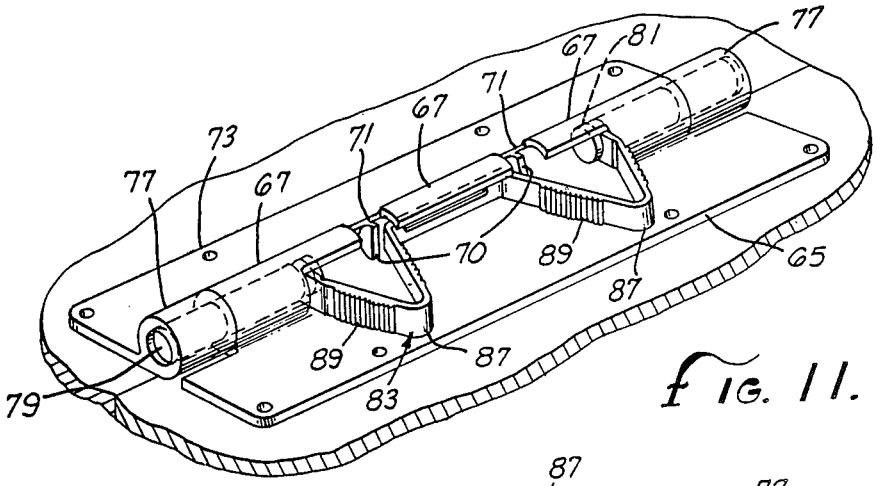
FIGS. 11, 12 and 13 are side elevational views of a third exemplary version of the invention.
Figure 13:
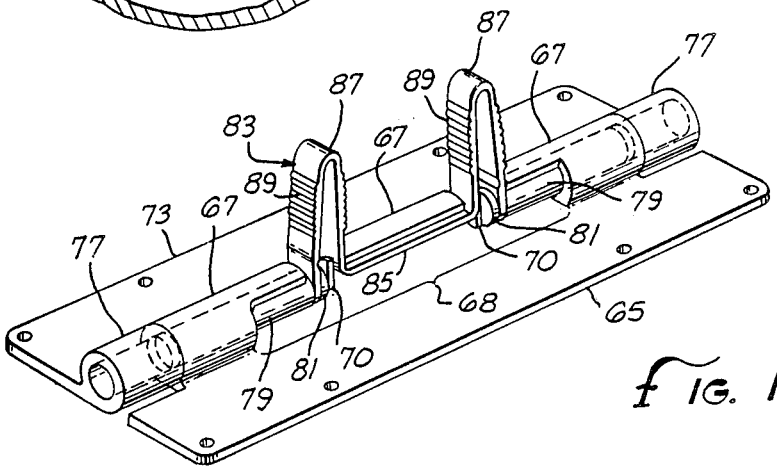
Figure 12:
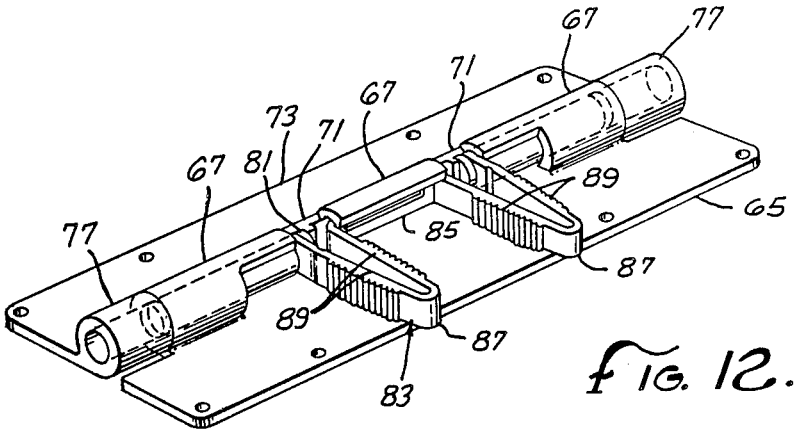

This preferred embodiment functions similarly to the other preferred embodiments in that when the spring-/actuator 83 is in a first position as shown in FIG. 11 the spring/actuator 83 forces the attached pins 79 partially out of the housing tube 67 and partially into the keeper tubes 77. The spring expansion force pushes a portion of each outer leg portion of the spring/actuator 83 against an edge of the housing tube at the outer edges of the axial portion 68 of the lateral tube opening. The pins 79 are thus held extended and the invention can serve as a hinged or latch.

When the outer leg portions of the spring/actuator are pinched towards each other into a second position (shown in FIG. 12) the pins 79 are retracted entirely within the housing tube 67 thereby detaching the housing 65 from the keeper 73. From this position the spring-/actuator 83 is rotated roughly 90 as in FIG. 13 such that a portion of each leg portion 89 rests in a radial portion 71 of the lateral groove opening. Portions of the two leg portions of each V-shaped portion 87 fit into respective radial portions 71 one leg on each side of the respective thin housing tube wall 70. When the spring-/actuator 83 is released the spring expansive force pushes each outer leg portion against an edge of the housing tube 67 allowing easy separation of the housing 65 and keeper 73 and any surfaces to which said housing 65 and keeper are attached.

Figure 15:
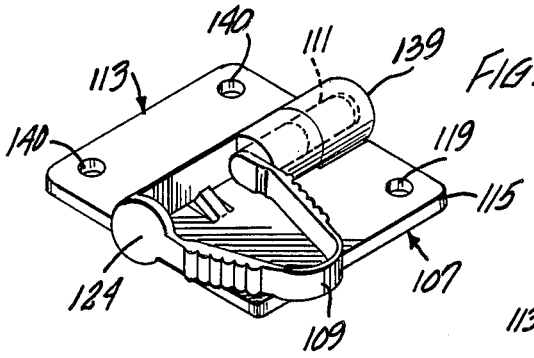
FIG. 15 is an elevational view of the exemplary version of the fourth embodiment of the invention.
Figure 16:
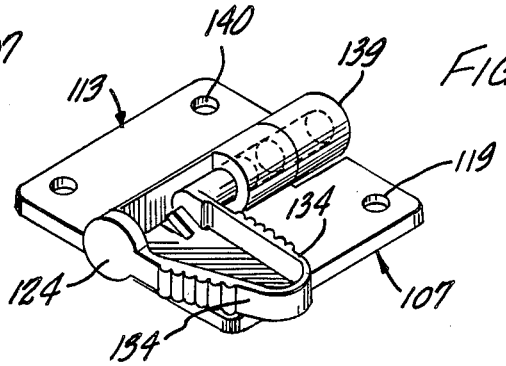
FIG. 16 is an elevational view of the exemplary version of the fourth embodiment of the invention in the second position.
Figure 17:
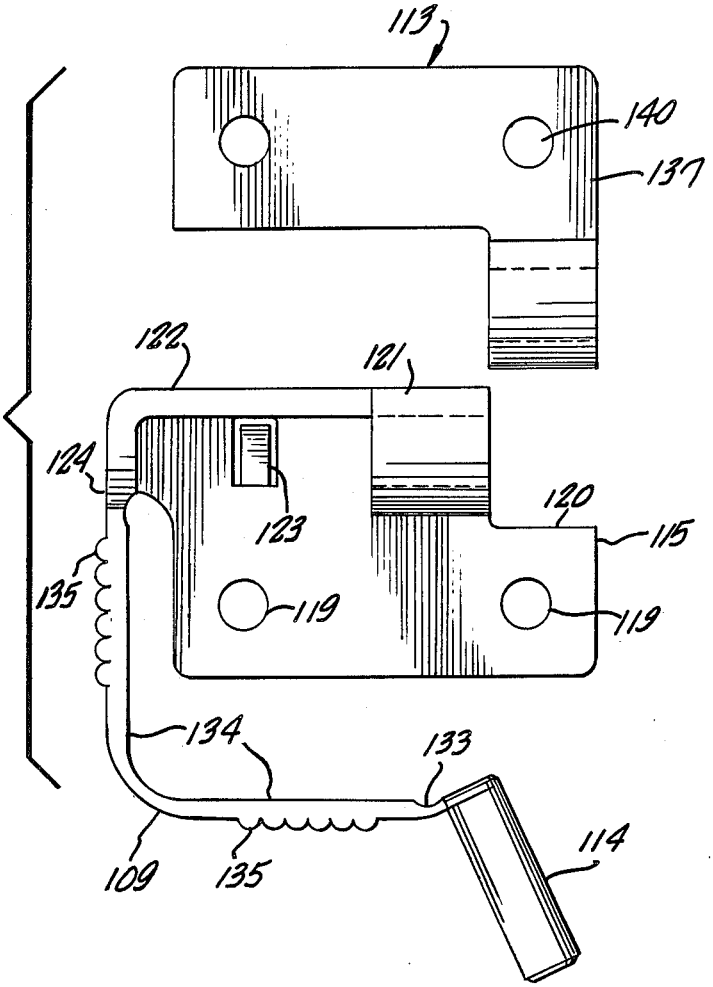
FIG. 17 is an exploded view of the components of the exemplary version of the fourth embodiment of the invention.

A fourth preferred embodiment of the present invention is shown in FIGS. 15–17. This embodiment is similar in structure and operation to the first embodiment. As in the first embodiment there is a housing 107 which is adapted to be attached to a surface (not shown). The housing 107 has a base portion 115 with a plurality of holes 119 disposed therethrough to permit the attachment of the housing 107 to the surface (not shown).

Attached to the housing 107 and extending upwardly therefrom along one edge is a housing tube 121 which is positioned along the housing 107 such that a recess 120 is formed. Extending from the housing tube 121 along the edge of the base portion 115 is a wall 122 which is integral with the base portion 115 and has a mount 124 at one end. The mount 124 is at a substantially right angle to the wall 122 and is also integral with the base portion 115.

A spring/actuator 109 has two leg portions 134 which are attached to form a flexible assembly useful for the purposes disclosed herein. Each of the leg portions 134 has a plurality of serrations 135 along their external surface to facilitate easy gripping when using the hinge/latch. One leg portion 134 is integral with the mount 124 and the other leg portion is attached to or integral with a pin 114. An elbow 133 exists between the pin 114 and the leg portion 134 to permit flexible movement of the pin 114 with respect to the leg portion 134.

Along the base portion 115 is a stop 123 which is formed by molding or cutting a groove and then pressing the stop 123 upward from the base portion 115. The stop 123 is disposed along the base portion 115 between the housing tube 121 and the mount 124 to permit the loading of the pin 114 into the housing tube 121 and then retaining the pin 114 within the housing tube 121. It should be apparent to those skilled in the art that other forms of stops could be utilized to accomplish the intended function.

A keeper 113 has a flat rectangular base portion 137 and a plurality of holes 140 disposed through the base portion 137 to permit the attachment of the base portion 137 to a second surface (not shown) via screws or other mechanisms. Along one edge of the base portion 137 is a keeper hollow tube 139 which extends upwardly from the base portion 137. The keeper hollow tube 139 fits within the recess 120 to permit the side-by-side juxtaposition of the base portion 115 with the base portion 137 as shown in FIGS. 15 and 16.

Use of the hinge/latch of the present invention is shown in FIGS. 15 and 16. After the base portion 115 has been attached to the first surface (not shown) and the base portion 137 has been attached to the second surface (not shown) the first and second surface are brought together such that the keeper hollow tube 139 fits within the recess 120. It is then possible to align the channels formed by the housing tube 121 and the keeper hollow tube 139.

Alignment of the channels permits the entry of the pin 114 into the channels to afix the first and second surfaces. To place the pin 114 into the channel formed by the housing tube 121 it is necessary to squeeze the leg portions 134 toward each other by application of a force to the serrations 135 located in each leg portion 134. After this has been done the pin 114 may be slid over the stop 123 and into the channel formed by the housing tube 121. Once the pin 114 has been placed into the housing tube 121 it will be retained in the channel of the housing tube 121 by the stop 123. The stop 123 is cantilevered to permit easy loading of the pin 114 into the housing tube 121.

Placement of the pin 114 into the channel of the housing tube 121 readies the hinge/latch for use. The spring/actuator 109 is biased to cause movement of the pin 114 into the channel formed by the keeper hollow tube 139. By permitting free movement of the leg portions 134 away from each other the pin 114 will move into the channel formed in the keeper hollow tube 139 thus affixing the first and second surfaces to one another. The stop 123 is positioned along the base portion 115 so that the pin 114 is permitted to leave the keeper hollow tube 139 and remain within the housing tube 121. The use of the pin 114 permits hinged radial movement of the first and second surfaces with respect to each other.

The fifth embodiment of the present invention is shown in FIGS. 18–20. This embodiment is similar in structure and operation to the embodiment shown in FIGS. 5–10.

As in the embodiment shown in FIGS. 5–10 there is a housing 201 which has a base portion 202 with a plurality of apertures 203 disposed therein to permit the attachment of the base portion 202 to a first surface (not shown). Extending upwardly from the base portion 202 are first and second housing tubes 204, 205 which are interconnected with a wall 206. The housing tubes 204, 205 are placed along the base portion 202 so that dual opposing recessed portions 207 are formed.

Formed from the base portion 202 is a stop 208 which is located substantially midway between the housing tubes 204, 205. The stop 208 is in the preferred embodiment formed from cutting out a U-shaped slot in the base portion 202 and then bending the stop 208 upward from the base portion 202.

A spring/actuator 210 has opposing legs 211 which are attached at joint 212 to permit flexible movement of the legs 211. Each leg 211 has a serrated section 213 along its external surface. Connected to each leg 211 at a flexible joint 214 is a pin 215 which may be formed integral with the respective leg 211 or attached in some other manner. Each joint 214 permits limited movement of the pin 215 with respect to the attached leg 211.

A keeper 220 has a base portion 221 which is provided with a plurality of apertures 222 to permit the afixation of the base portion 221 to a second surface (not shown). Extending outwardly and upwardly from the base portion 221 are dual keeper hollow tubes 223 which are sized to fit within the recesses 207 found within the base portion 202.

The use of the invention of the fifth embodiment is shown in FIGS. 18 and 19. The base portion 202 is attached to the first surface (not shown) and the base portion 221 is attached to the second surface (not shown). After this has been accomplished the two surfaces are drawn together such that the keeper hollow tubes 223 fit within the recesses 207. In this position the base portion 202 is parallel to the base portion 221 and the channels formed by the housing tubes 204, 205 are aligned with the respective opposing channels of the keeper hollow tubes 223.

After the alignment of the channels referred to above has been accomplished the leg portions 213 are pressed toward each other thus bringing the pins 215 closer to one another (as shown in phantom). Each pin may be fitted over the stop 208 and into the channel formed by the respective housing tubes 204, 205. By releasing pressure on the leg portions 211 the biased spring/actuator will cause the pins 215 to move into the channels formed by the keeper hollow tubes 223. The inoperative state is shown in FIG. 19 and the operative state of the present hinge/latch is shown in FIG. 18.

The stop 208 is operative to retain the pins 215 within the channels formed by the housing tubes 204, 205 but permit the selective movement of the pins out of the channels formed by the keeper hollow tubes 223. The stop 208 is cantilevered to permit easy loading of the pins 215 into the housing tubes 204, 205. After the pins 215 are disposed into the channels formed by the keeper hollow tubes 223 the present invention is operative to maintain two surfaces in a hinged relationship.

The spring/actuator 210 may be rotated from a position wherein the leg portions are parallel to the wall 206 and extending upwardly from the base portion 202 to a position where the spring/actuator 210 is flush with the base portion 202. In the later position the low profile of the spring/actuator is desirable to reduce the possibly of inadvertent contact.

While preferred embodiments of the present invention have been disclosed, numerous alternatives and equivalents which do not depart from the spirit of the invention will occur to those skilled in the art given the benefit of the present teachings, and these alternatives and equivalents are intended to be included herein.

What is claimed is:

1. A quick release hinge/latch comprising a housing having a first tube thereon;

a pin adapted to slide within said first tube and including a flat spring integrally formed therewith having a first end fixed relative to said housing and a second end integral with said pin, said pin and spring being of one piece construction, said flat spring biasing said pin axially outwardly of said first tube and extending laterally outwardly of said tube from each said end of said flat spring for manual gripping between said ends laterally outwardly of said tubes to compress said flat spring and retract said pin into said first tube.

2. The quick release hinge/latch of claim 1 further comprising a keeper having a second tube adapted to receive said pin therein when said pin is outwardly of said first tube.

3. The quick release hinge/latch of claim 1 wherein said flat spring is C-shaped.

4. The quick release hinge/latch of claim 3 wherein said flat spring has serrated surfaces on the portions of said flat spring extending laterally outwardly of said tube.

5. The quick release hinge/latch of claim 1 wherein said first tube includes a lateral opening having an axially extending portion through which said second end extends to said pin.

6. The quick release hinge/latch of claim 1 wherein said pin, flat spring, and housing are integrally formed in one piece.

7. A quick release hinge/latch comprising a housing having a first tube thereon;

pins adapted to slide within said first tube, said pins including a flat spring integrally formed with said pins and having a first end integrally fixed to a first said pin and a second end integrally fixed to a second said pin, said pins and said spring being of one piece construction, said flat spring biasing said first and second pins axially outwardly of said first tube and extending laterally outwardly from said tube from each said end of said flat spring for manual gripping between said ends laterally outwardly of said tubes to compress said flat spring and retract said pins into said first tube.

8. The quick release hinge/latch of claim 7 wherein said flat spring is C-shaped.

9. The quick release hinge/latch of claim 7 wherein said first tube includes two lateral openings having axially extending portions through which said ends of said flat spring extend to said pins.

10. The quick release hinge/latch of claim 9 wherein said lateral openings have radially extending portions adapted to receive the ends of said flat spring with said flat spring compressed to retract said pins into said tube.

* * * * *